US005471976A

United States Patent [19]

Smith

[11] Patent Number: 5,471,976

[45] Date of Patent: Dec. 5, 1995

[54] MINI DIVING SYSTEM

[76] Inventor: Raymond K. Smith, 46 N. Front St., Philadelphia, Pa. 19106

[21] Appl. No.: 73,681

[22] Filed: Jun. 9, 1993

[51] Int. Cl.[6] ..... B63C 11/02

[52] U.S. Cl. ..... 128/201.27; 128/201.28; 128/204.26; 128/205.24

[58] Field of Search ..... 128/201.11, 201.27, 128/201.28, 204.26, 205.24

[56] References Cited

U.S. PATENT DOCUMENTS

| | | | |
|---|---|---|---|
| 813,431 | 2/1906 | Iwanami et al. | 128/201.28 |
| 3,050,055 | 8/1962 | Vautin | 417/61 |
| 3,370,586 | 2/1968 | Aragona | 128/201.11 |
| 3,393,643 | 7/1968 | Herman | 415/7 |
| 3,397,647 | 8/1968 | Daniel | 417/61 |
| 3,398,878 | 8/1968 | Ouiran et al. | 417/363 |
| 3,467,091 | 9/1969 | Aragona | 128/201.27 |
| 4,219,017 | 8/1980 | Shamlian et al. | 128/204.26 |
| 4,362,154 | 12/1982 | Le Masson | 128/204.22 |
| 4,446,859 | 5/1984 | Pedersen | 128/204.26 |
| 4,494,537 | 1/1985 | Gottlieb | 128/204.26 |
| 4,674,493 | 6/1987 | Mitchell | 128/204.26 |
| 4,832,013 | 5/1989 | Hartdorn | 128/201.28 |
| 4,938,211 | 6/1990 | Takahashi et al. | 128/201.27 |
| 4,986,267 | 6/1991 | Dess | 128/201.27 |
| 5,193,530 | 3/1993 | Gamow et al. | 128/201.27 |

FOREIGN PATENT DOCUMENTS

| | | | |
|---|---|---|---|
| 2593136 | 7/1987 | France | 128/201.28 |

*Primary Examiner*—Aaron J. Lewis

[57] ABSTRACT

Disclosed is a mini diving device that provides diving in a limited depth of water of extended periods of time. The diving device (FIG. 1) is comprised of a low pressure regulator (FIG. 2). An air intake line which includes an expandable hose. Attached to the air intake line is a waterproof vessel container enclosing a battery operated air pump. The pump draws air from the surface of the water through a vertical extended tubing.

2 Claims, 1 Drawing Sheet

MINI DIVING SYSTEM

BACKGROUND OF THE INVENTION

The desire to probe under water for recreational purposes or emergencies or maintenance care of boats is an ongoing need. The first interest being well stated in numerous patents. Between the limitation of snorkels and the complication of scuba systems, several attempts to find a solution to limited diving between the two aforementioned have resulted in the following approaches: Prior art cites gasoline engines, motors, pumps, batteries, trailing pressure tanks and an assortment of these well known items being placed on ties, flotation devices and other assorted vessels. These assortments of well known machinery were all intended to generate pressurized air which would be conveyed by a hose or tubing to a standard diving regulator.

All the flotation systems cited suffer from a number of disadvantages:

(a) The most underlying problem is the complication and pressure demanded by available scuba regulators.

(b) The size and bulk requires large and unwieldy flotation devices, none of which could be easily transported.

(c) The combined costs for all the required pieces of equipment would have excluded it from the recreational market.

(d) Systems citing the use of gasoline engines incur dangers with complicated engines emitting toxic fumes in close proximity of air intakes for divers.

(e) Any battery system that could provide the necessary liters per minute of air on demand would be enormous and not portable in the realistic sense.

There is one exception to this effort to find a middle solution to diving, that being U.S. Pat. No. 4,938,211 by Takahashe et al. It is both very novel and workable. It operates on a very different principle than the present invention however, using a closed system avoiding the standard regulator. The basic drawback is the need to change cartridges every 10 to 20 minutes. And again retail sales price limits the market.

SUMMARY OF THE INVENTION

Figure 1:
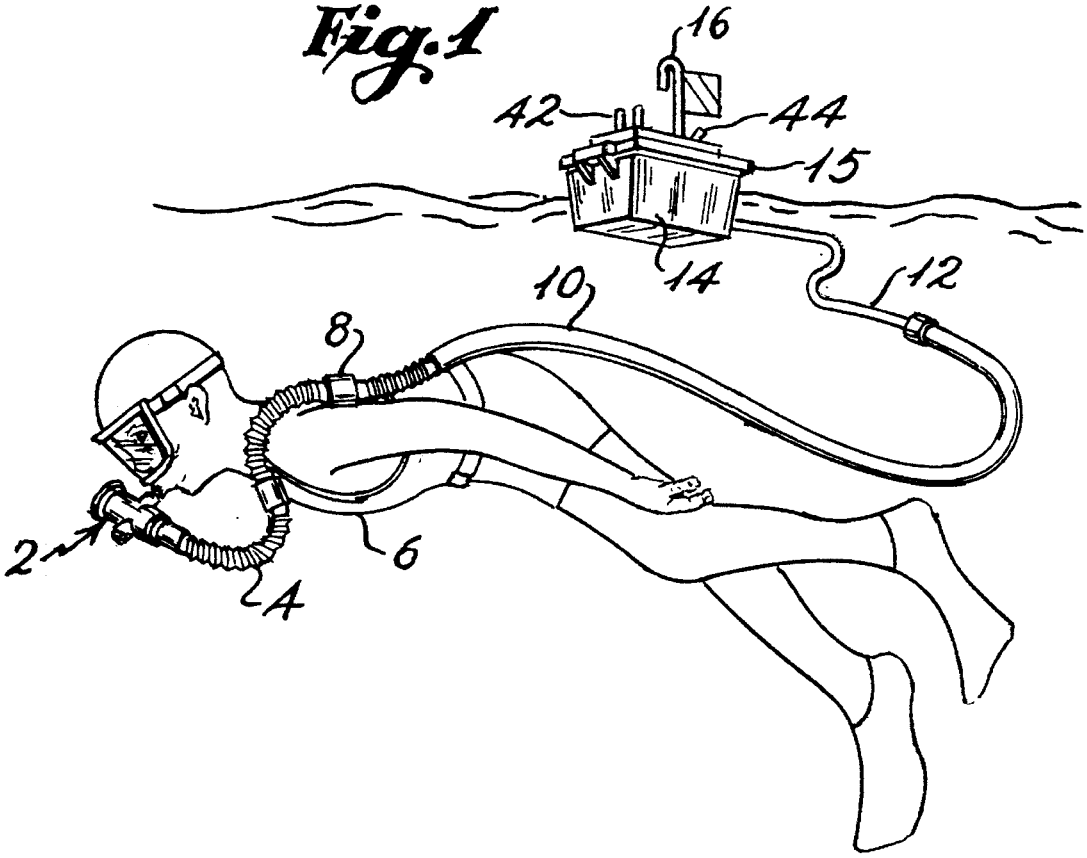
FIG. 1 is the total embodiment of the diving system.

In view of the foregoing disadvantages inherent in the known types of underwater breathing regulators now present in the prior art, the present invention provided an improved underwater breathing device wherein the use of high pressure compressed air cylinders or substantial air compressors are not needed. As such, the general purpose of the present invention, which will be described subsequently in greater detail, is to provide a new and improved underwater limited diving device which has all the advantages of the prior underwater devices and none of the disadvantages.

According to the present invention air at an adequate flow rate and a sufficiently low pressure to be safely inhaled by a person underwater is supplied from an air pump housed in a floating sealed buoyant container. The air is supplied to the person underwater by flexible tubing from the pump to a low-pressure regulator and mouthpiece. Although the depth to which the person underwater can descend is restricted both by increasing water pressure and the limited length of the flexible tubing, the person's lateral range is not so restricted inasmuch as the buoyant container on the surface trails the person underwater.

The flexible tubing comprises several sections: the first section of conventional tubing simply delivers air from the pump to the second section: the radially contracting accumulator tube. Because the pump supplies air continuously but breathing is intermittent, the accumulator tube radially contracts under the external water pressure while the person underwater is inhaling, thereby supplying air in addition to the flow directly from the pump. During exhaling the accumulator stores air from the pump by returning to its normal diameter. The third section of tubing: conventional corrugated tubing which carries the air from the accumulator to the regulator and accommodates normal underwater head and body movement.

When one breathes, as a diver would, one inhales in large gulps which translates into the need for ½ liters per minute in a span of 2 to 3 seconds. Such a demand can not be provided by a portable sized electric air pump and battery system presently available. However, by utilizing the contractible tube concept which accumulates an air supply between breaths, it is possible to attain the necessary flow of air for diving in limited depth water with a pump with minimal output of breathable air, thereby avoiding a larger pump and necessary heavier battery. The contractible tubing has two other distinct advantages. First, the withdrawing of air from the tube does not create a depleted space as would occur in a rigid storage tank, this avoiding difficulty in inhaling air. The second advantage of my contractible tubing concept which can operate at pressures as low as two atmospheres is that it avoids the need of high pressure tanks or pumps that supplies air at pressures as high as ten atmospheres at the intake of the regulator, as is standard in the art of regulators.

Another improvement of my invention is a low pressure regulator that can operate on the pressure generated by ones breathing action alone. This makes it possible to use by regulator while entering or exiting the water. It is not necessary for my regulator to be in the water to operated as is necessary with all other regulators. This extreme sensitivity is accomplished by using a unique principle of opening and closing of a valve. One end of a fixed tube is attached to the air input in the regulator housing. This tube, which is open to the accumulator, is pierced by a circumferential line of ports. A moveable coaxial sleeve slides over the fixed tube, and is pierced by a similar circumferential line of ports. The moveable sleeve is capped at its end opposite to the fixed tube. When the circumferential ports of the sleeve align with the circumferential ports of the fixed tube, air from the accumulator can escape from the fixed tube. The sleeve is attached to a rubber diaphram which is exposed to the water pressure outside the chamber and the air pressure within the chamber.

During inhaling when the water pressure is greater than the pressure inside the chamber, the diaphram deflects inward, thereby moving the sleeve axially until the circumferential ports on the fixed tube and the sleeve align thereby releasing the air stored in the accumulator. During exhaling when the internal pressure exceeds the water pressure the diaphram deflects outwards, retracting the second member, thereby closing off the circumferential ports of the first member. This arrangement avoids the need for highly loaded springs at the intake valve. Accordingly, the function of the low-pressure regulator is not to reduce a conventional high-pressure air supply to accommodate breathing, but to accommodate intermittent breathing to air continuously supplied at an adequate flow-rate and safe pressure for direct breathing.

The entire mini diving system is easily portable with a sealed battery with recessed battery posts or clips; it is safe and legal for transporting through the mail or accompanying one on an airplane.

DESCRIPTION OF INVENTION

Figure 2:
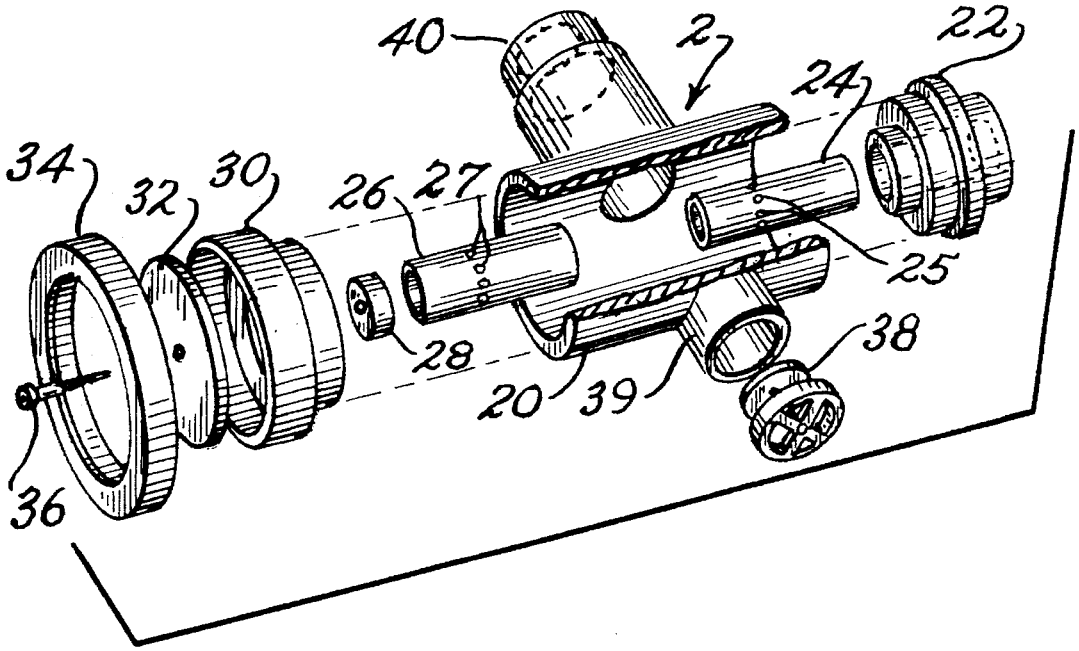
FIG. 2 shows detail of the low pressure breathing regulator.

With reference now to the drawings, and in particular to FIG. 1 thereof, herein shall be described a new underwater breathing device embodying the principles and concepts of the present invention and generally designated by the reference numeral 1. More specifically, it will be noted that the breathing device FIG. 2 essentially comprises a hollow chamber 20 with three ports: mouthpiece port 40, intake port 22 and exhaust port 39. Intake housing 22 supports a fixed intake tube 24 which has a circumferential line of ports 25. Tube 24 slideably supports axially moveable sleeve 26 which also has a circumferential line of ports 27. Cap 28 seals the end of sleeve 26 opposite to tube 24. Connected to the cap 28 by fastener 36 is a rubber diaphram 32 which is secured by tube 30 and retainer ring 34.

Axial movement of diaphram 32, secured to coaxial sleeve 26 causes sleeve 26 to slide along coaxial fixed tube 24. When diaphram 32 is fully depressed as a result of air being inhaled through mouthpiece port 40 sleeve 26 slides along tube 24 allowing circumferential ports 27 on tube 26 to align with circumferential ports 25 on sleeve 24, releasing air from intake housing 22 through tube 24 to mouthpiece port 40.

As a result of air being exhaled through mouthpiece port 40 diaphram 32 expands out, moving sleeve 26 axially along tube 24 and thereby misaligning circumferential holes 27 on tube 26 with circumferential holes 25 on sleeve 24. Exhaled air is therefore blocked from back-flowing to intake housing 22 and instead is expelled through conventional check valve 38 and out through exhaust port 39.

Covered buoyant container 14 houses a conventional electric-motor powered air pump and battery, the source of air to intake housing 22. Extending through waterproof lid 15 of container 14 are battery posts 42, a conventional toggle switch 44 to control the electric motor, and intake tube 16 to supply air to air pump. The air from the air pump reaches regulator intake housing 22 through an arrangement of connected flexible tubes. Ordinary flexible tubing 12 carries air from the air pump to accumulator tubing 10. Tubing 10 connects to corrugated hose 4 at a clip connection 8 which secures tubings 10 and 4 to vest 6. Corrugated hose 4 carries air to intake housing 22.

While there have been described what is at present considered to be the preferred embodiment of a mini diving system, it will be obvious to those skilled in the art that various changes and modifications may be made therein without departing from the invention. It is aimed therefore in the appended claims to cover all such changes and modifications as fall within the true spirit and scope of the invention so that others may, by applying current and future knowledge, adopt the same for use under various conditions of service.

I claim:

1. An underwater breathing device comprising an air delivery means and an air regulating means;

said air delivery means comprising a flexible accumulator tube which accumulates continuous low-pressure air at an adequate flow rate for direct breathing from a minimal-capacity electric air pump housed within a buoyant container and delivers said low-pressure air to said air regulating means for a person underwater, thereby avoiding a conventional rigid air storage tank; and said air regulating means utilizing a slideable low-pressure porting device, thereby avoiding the highly loaded regulator springs required at the intake valve of a conventional high-pressure regulator;

whereupon said underwater breathing device is accordingly sufficiently portable to be transportable through the mail or to accompany a passenger on an airplane, said underwater breathing device further including an air-supply regulating means supplied with continuous low-pressure air for a person underwater, said regulator comprising a chamber with an intake port, mouthpiece port, exhaust port and a diaphram exposed to water pressure;

whereupon inhaling by a person underwater from said chamber through said mouthpiece port deflects said diaphram inwards, imparting axial motion to a movable sleeve to which said diaphram is secured, said sleeve coaxially and slidably secured to fixed tube connected to continuous low-pressure air through said intake port, said fixed tube and moveable sleeve pierced by a circumferential line of ports; said axial motion of said movable sleeve aligning said circumferential ports, thereby releasing low-pressure air to said chamber and thence to said mouthpiece port;

whereupon exhaling by a person underwater into said chamber through said mouthpiece port deflects said diaphram outwards, causing axial motion of said moveable sleeve to which said diaphram is secured; said axial motion of said moveable sleeve misaligning said circumferential ports, thereby blocking low-pressure air to said chamber; whereupon exhaled air is expelled through said exhaust port;

said regulator thereby permitting input of low-pressure air at a pressure safe for breathing from a continuous air supply while accommodating intermittent breathing.

2. An accumulator tube according to claim 1 comprising a flexible radially contractible tube whereupon inhaling low-pressure air from a continuous air-supply means by a person underwater said accumulator tube contracts under external water pressure, thereby supplying accumulated air, in addition to low-pressure air from a continuous air supply means, to a person underwater; and upon exhaling by a person underwater said accumulator tube returns to its normal diameter by accumulating air from a continuous air supply, thereby accommodating a continuous air-supply means to the normal intermittent breathing of a person underwater.

* * * * *